US007178669B2

(12) United States Patent
Atkinson et al.

(10) Patent No.: US 7,178,669 B2
(45) Date of Patent: Feb. 20, 2007

(54) TIRE STORAGE SYSTEM

(76) Inventors: Yvette S. Atkinson, 13338 Georgetown Dr., Sugar Land, TX (US) 77478; Simon J. Atkinson, 13338 Georgetown Dr., Sugar Land, TX (US) 77478; Stevens Sanchez, 11616 Seashore, Houston, TX (US) 77072; Suzanne Sanchez, 11611 Seashore, Houston, TX (US) 77099

( * ) Notice: Subject to any disclaimer, the term of this patent is extended or adjusted under 35 U.S.C. 154(b) by 207 days.

(21) Appl. No.: 10/788,722

(22) Filed: Feb. 27, 2004

(65) Prior Publication Data

US 2004/0232093 A1 Nov. 25, 2004

(51) Int. Cl.
*B65D 85/04* (2006.01)

(52) U.S. Cl. ..... 206/304

(58) Field of Classification Search ..... 206/302–304, 206/304.1, 304.2, 335, 821; 211/19, 20, 211/23; 220/503–505, 508, 509; 224/42.12, 224/42.26

See application file for complete search history.

(56) References Cited

U.S. PATENT DOCUMENTS

| | | | | | |
|---|---|---|---|---|---|
| 1,733,918 | A | | 10/1929 | Spotswood | |
| 1,943,237 | A | | 1/1934 | Harrington | |
| 2,632,268 | A | | 3/1953 | Schroeder | |
| 3,033,804 | A | * | 5/1962 | Bethe et al. | 521/54 |
| 3,707,789 | A | | 1/1973 | Hart | |
| 4,225,626 | A | * | 9/1980 | Chiu et al. | 426/520 |
| 4,242,169 | A | * | 12/1980 | DeHaven | 156/396 |
| 4,304,279 | A | * | 12/1981 | Thomas | 206/303 |
| 4,309,234 | A | * | 1/1982 | Witherspoon | 156/96 |
| 4,516,706 | A | | 5/1985 | Niehaus | |
| 4,658,955 | A | * | 4/1987 | Eichner | 206/307 |
| 4,664,260 | A | * | 5/1987 | Stokes | 206/386 |
| 4,671,409 | A | * | 6/1987 | Espy | 206/397 |
| 4,893,713 | A | * | 1/1990 | Thomas | 206/304 |
| 5,033,621 | A | * | 7/1991 | Hulet | 206/501 |
| 5,054,617 | A | * | 10/1991 | Young et al. | 206/509 |
| 5,321,931 | A | * | 6/1994 | Bluteau | 53/435 |
| 5,971,462 | A | | 10/1999 | Bell et al. | |
| 5,996,863 | A | | 12/1999 | Burke | |
| 6,082,803 | A | | 7/2000 | Klueger | |
| 6,729,485 | B2 | * | 5/2004 | Ehrgott | 211/189 |
| 6,809,129 | B2 | * | 10/2004 | Abu-Isa | 523/179 |
| 2004/0241410 | A1 | * | 12/2004 | Fischer et al. | 428/292.1 |

* cited by examiner

*Primary Examiner*—Mickey Yu
*Assistant Examiner*—Steven Pollicoff
(74) *Attorney, Agent, or Firm*—Carrie A Boone, PC

(57) ABSTRACT

A tire storage system is disclosed, for securely storing one or more tires. The tire storage system consists of two identical tire caps and a connecting spacer. One of the tire caps is placed horizontally on a flat surface. The used tire is placed upon one of the tire caps, such that part of the tire cap extends upward through the opening of the tire. The spacer is securely affixed to the tire cap, and generally fills the rest of the tire opening. The other tire cap is placed horizontally over the tire and is also secured to the spacer. The tire storage system seals the inside of the tire from outside access, so as to prevent mosquito breeding and infestation. The tire storage system can be used to stack multiple tires of different sizes, for efficient storage, and can be recycled with the tire at a later time. The tire storage system can be made from or treated with fire-retardant materials, to inhibit unwanted fires.

18 Claims, 7 Drawing Sheets

TIRE STORAGE SYSTEM

FIELD OF THE INVENTION

This invention relates to the collection of used tires and, more particularly, to the safe storage of used tires.

BACKGROUND OF THE INVENTION

The disposal of used tires is a big problem. Billions of used tires are stockpiled, and hundreds of millions of used tires are added to that number each year in the United States alone. Regardless of how they are stored or stacked, used tires inevitably collect water inside their hollow structure. The water quickly provides a breeding ground for rats, snakes, and mosquitoes.

A used tire left unattended will often collect water from rainfall. This quickly causes mosquito infestation, which is of particular concern, due to the many diseases spread by this insect. Malaria, West Nile virus, Dengue fever, and Encephalitis are a few of the diseases that may result from the improper storage of old tires. Once an infestation occurs, it can spread quickly. As of February 2003, the West Nile Virus has infected 4008 people, resulting in 263 deaths, affecting about three-quarters of the states in the United States. The West Nile virus problem has even caused disruption in the collection of blood, in some communities.

Pesticides are sometimes used in communities where infestation is likely. The benefit of pesticide spraying is the subject of much heated debate. Pesticides, such as Malathion, have been classified as carcinogens by the United Stated Environmental Protection Agency. These known neurotoxins are considered hormone disruptors and have been shown to cause cancer in animals. Environmentalists assert that the chemicals used in pesticides have not been adequately tested for their effects on human health.

Further, pesticides are very expensive as a solution to mosquito infestation. In the pesticide-spraying contract for one community, for example, $125,000 was spent on the aviation and labor costs while $225,000 was spent on the pesticide chemicals.

Used tires are sometimes shredded to prevent mosquito infestation. Huge mounds of shredded rubber are susceptible to spontaneous combustion, resulting in hazardous fires. These unwanted fires produce black smoke containing carcinogens such as benzene, toluene, and xylene, invading nearby communities with pollution, while toxic oil from the fires permeates the soil and contaminates waterways.

Federal, state, and local laws are enacted to regulate the outside storage of used tires. Unfortunately, these regulations have largely been ineffective and, in some instances, have actually compounded the problem. In many states, it is illegal to store tires outside, which limits the number of tires a recycling center can receive. Often, the result is the illegal dumping of used tires.

Scrap tires have many end uses. Used tires can be made into crumb rubber and used for land reclamation projects, septic system facilities, asphalt highway, agriculture, stamped products, artificial reefs, and landfill operation. They can also be used as fuel and can be exported for use outside the United States. Unfortunately, though, a great many scrap tires end up in legal and illegal dumping locales, making nearby communities vulnerable to the aforementioned problems.

Thus, there is a continuing need for a device that can be used to safely store used tires. The used tires should be stored in a manner that will prevent mosquito infestation and unwanted fires from occurring before the tires are recycled.

DETAILED DESCRIPTION

In accordance with the embodiments described herein, a tire storage system is disclosed, for securely storing one or more tires. The tire storage system consists of two identical tire caps and a connecting spacer. One of the tire caps is placed horizontally on a flat surface. The used tire is placed upon one of the tire caps, such that part of the tire cap extends upward through the opening of the tire. The spacer is securely affixed to the tire cap, and generally fills the rest of the tire opening. The other tire cap is placed horizontally over the tire and is also secured to the spacer.

The tire storage system seals the inside of the tire from outside access, so as to prevent mosquito breeding and infestation. The tire storage system can be used to stack multiple tires of different sizes, for efficient storage, and can be recycled with the tire at a later time. The tire storage system can be made from or treated with fire-retardant materials, to inhibit unwanted fires.

Figure 1:
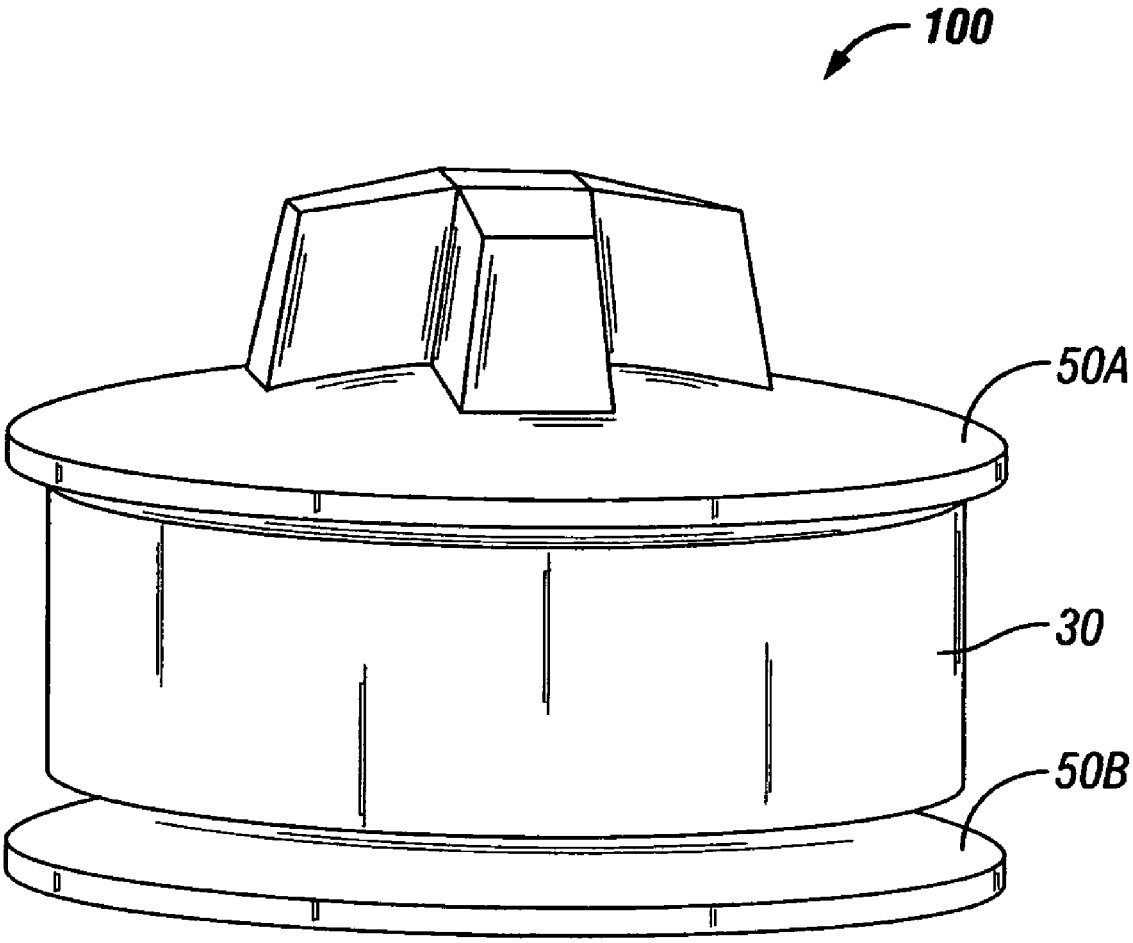
FIG. 1 is a perspective view of a tire storage system, according to one embodiment of the invention.
Figure 2:
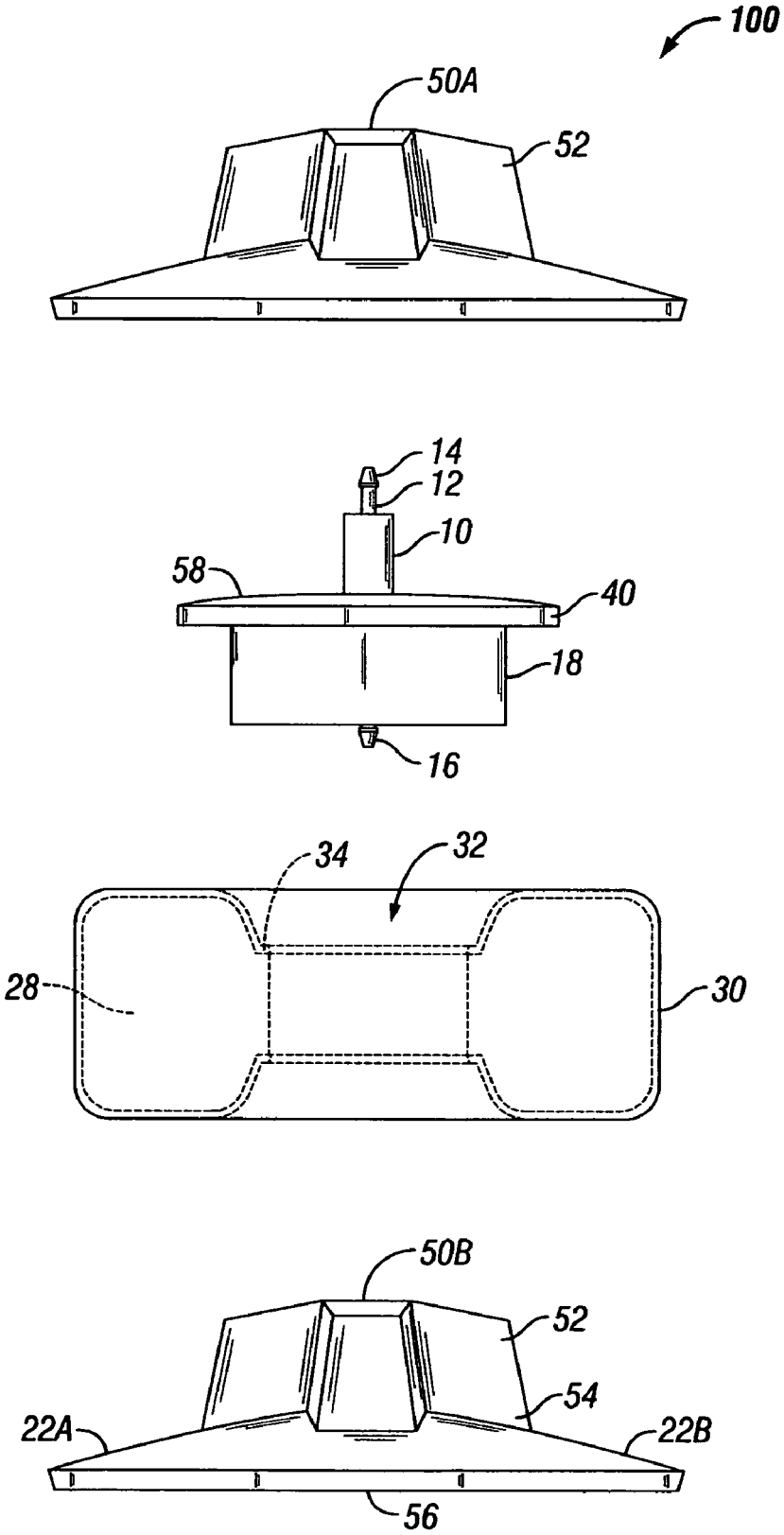
FIG. 2 is an exploded perspective view of the tire storage system of FIG. 1, according to one embodiment of the invention.

Referring to FIGS. 1 and 2, a tire storage system 100 is shown, for sealing a tire 30, according to some embodiments. The tire storage system 100 includes two identical tire caps, described for clarity as an upper tire cap 50A and a lower tire cap 50B (collectively, tire caps 50), where the upper and lower terms describe the position of each tire cap relative to the tire 30. The two tire caps 50 are coupled together by a spacer 40, at which point the tire storage system 100 is fully engaged.

The upper tire cap 50A, the spacer 40, and the lower tire cap 50B are composed of a rigid plastic material, such as a thermoplastic or elastomeric compound. While the materials selected for producing the tire caps 50 and spacer 40 are selected for strength and rigidity, flexibility may also be preferred, particularly for the tire caps. The components may be produced using injection molding or other polymer fabrication process.

The spacer 40 includes a body 18, which is cylindrical in shape, and disposed horizontally above the tire 30 in FIG. 2.

A top portion 58 extends horizontally across the body 18. The top portion 58 has a larger diameter than the body, which causes the top portion to project outward from the body, as a cantilever. A thin cylinder 10 is disposed orthogonally through the center of and extends vertically beyond the dimension of the body 18. The thin cylinder 10 provides some structural rigidity in the vertical direction of the spacer 40.

Inside the thin cylinder 10 is a connecting rod 12 with an upper tip 14 and a lower tip 16. The upper tip 14 is insertable into the upper tire cap 50A while the lower tip is insertable into the lower tire cap 50B. In one embodiment, the body 18, the top portion 58, the cylinder 10, and the connecting rod 12 of the spacer 40 are molded as a single part.

Figure 3:
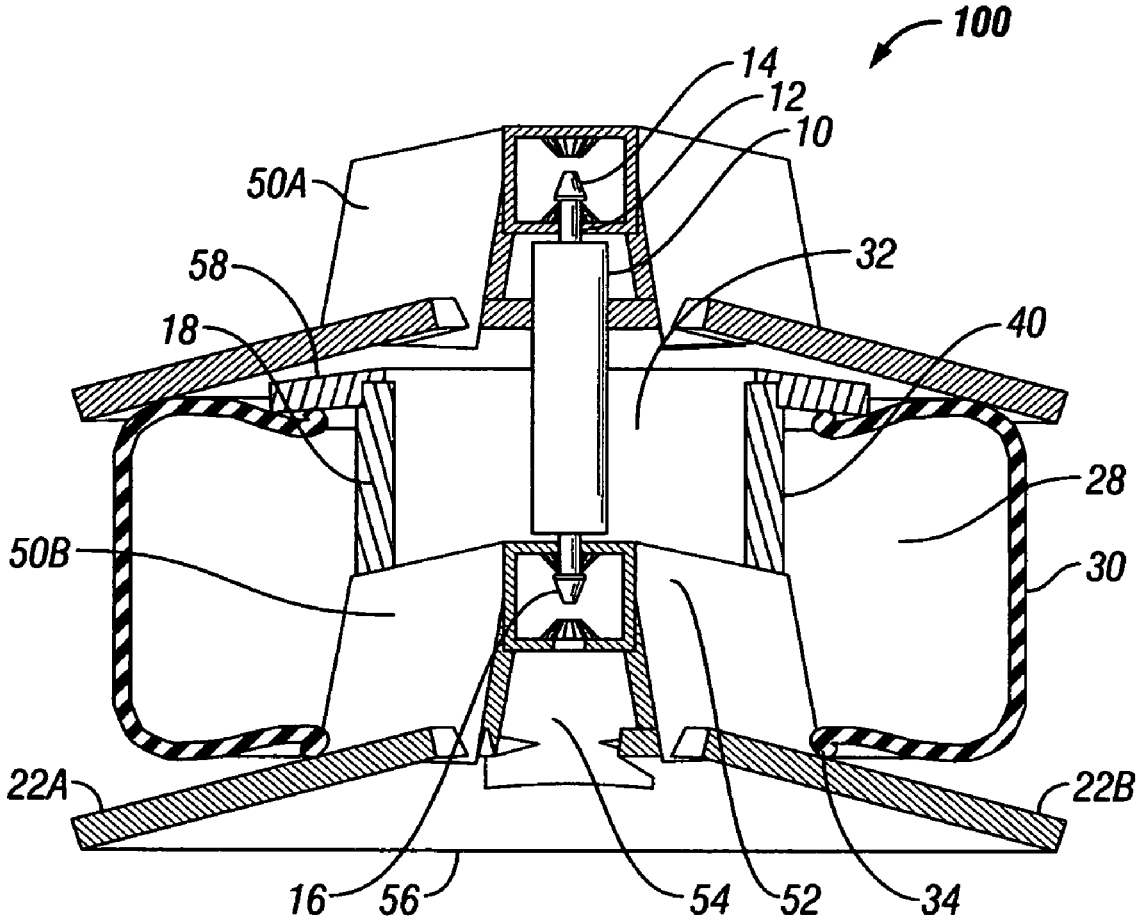
FIG. 3 is a cutaway side view of the tire storage system of FIG. 1, according to one embodiment of the invention.

Before connecting the tire caps 50 together, the spacer 40 is insertable into an opening 32 of the tire 30 (see also FIG. 3). The tire 30 may be one of a variety of tires used on both consumer and commercial vehicles. The tire 30 may be made of a rubber or other elastomeric material, or be composed of a composite material including rubber. The tire 30 is substantially toroidal in shape, having a hollow inside 28 and the opening 32 in the center of the tire. A bead 34, to be disposed against a rim (not shown), surrounds the opening 32 of the tire. The bead 34 may be a bit thicker than the rest of the tire and is slightly curled. When the tire is used on an automobile or other vehicle, the bead seals the tire to the rim of the automobile.

The tire caps 50, which are somewhat "hat-like" in shape, each include a head portion 52 and a base portion 54. The upper tire cap 50A is disposed atop the tire 30, directly over the opening 32. The lower tire cap 50B sits beneath the tire, such that the head portion 52 fits into opening 32 of the tire and the bead 34 surrounds the head portion. The head portion 52 of the tire cap 50 is cylindrical in shape so that the tire 30 remains atop the tire cap once it has been seated thereon.

The base portion 54 of the tire cap 50 is substantially conical in shape, including a bottom 56 and two sides 22A and 22B (collectively, sides 22). The base portion 54 is connected to the head portion 52 as shown. The bottom 56 is disposed horizontally on a surface, such on the ground or atop another tire cap in a stacking configuration (see FIG. 4, below). The bottom 56 stabilizes the tire cap 50, so that it can support a tire or a stack of tires.

In FIG. 3, a cutaway side view of the tire storage system 100 is shown, in which the tire 30 is disposed on the lower tire cap 50B. The spacer 40 sits atop the lower tire cap 50B, just above the head portion. The top portion 58 of the spacer rests upon the bead 34 of the tire. The head portion 52 of the lower tire cap 50B and the spacer 40 together fill a substantial amount of the space of the opening 32 of the tire. The upper tire cap 50A sits atop the opening 32 of the tire 30 and over the spacer 40. The connecting rod 12 is securely fastened into the tire caps 50A and 50B, such that the tire storage system 100 fully assembled.

Looking particularly at the lower tire cap 50B in FIG. 3, when the bottom 56 is disposed horizontally atop a surface, the two sides 22A and 22B of the base portion 54 are gently sloped, while the tire 30 is seated thereon in a horizontal position. By gently sloping the sides 22 of the base portion 54, the base portion 54 is more likely to seal against the bead 34 of the tire 30 than if the sides 22 had no slope. The sealing action of the tire storage system 100 substantially prevents access to the inside 28 of the tire, such that mosquitoes will no longer find the tire an attractive breeding ground. The absence of mosquitoes will discourage the collection of rats and other vermin, as well as snakes that eat them. Further, the gentle slope of the sides 22 ensures that, during rainy conditions, water will run off any exposed portion of the tire cap rather than collect in puddles atop or inside the tire storage system.

In FIGS. 1 and 3, the tire 30 is actually seated upon the lower tire cap 50B. A second tire storage system (not shown) may be placed atop the tire storage system 100. This is because the tire caps 50 are stackable with one another. A lower tire cap 50B from one tire storage system 100 can be placed atop an upper tire cap 50A from a second tire storage system. The placement of tire storage systems 100 atop one another can be repeated so that multiple tire storage systems form a stack, such as in the tire stack 70 of FIG. 4. Each tire 30 of the tire stack 70 is surrounded by a dedicated upper tire cap and a lower tire cap.

Figure 4:
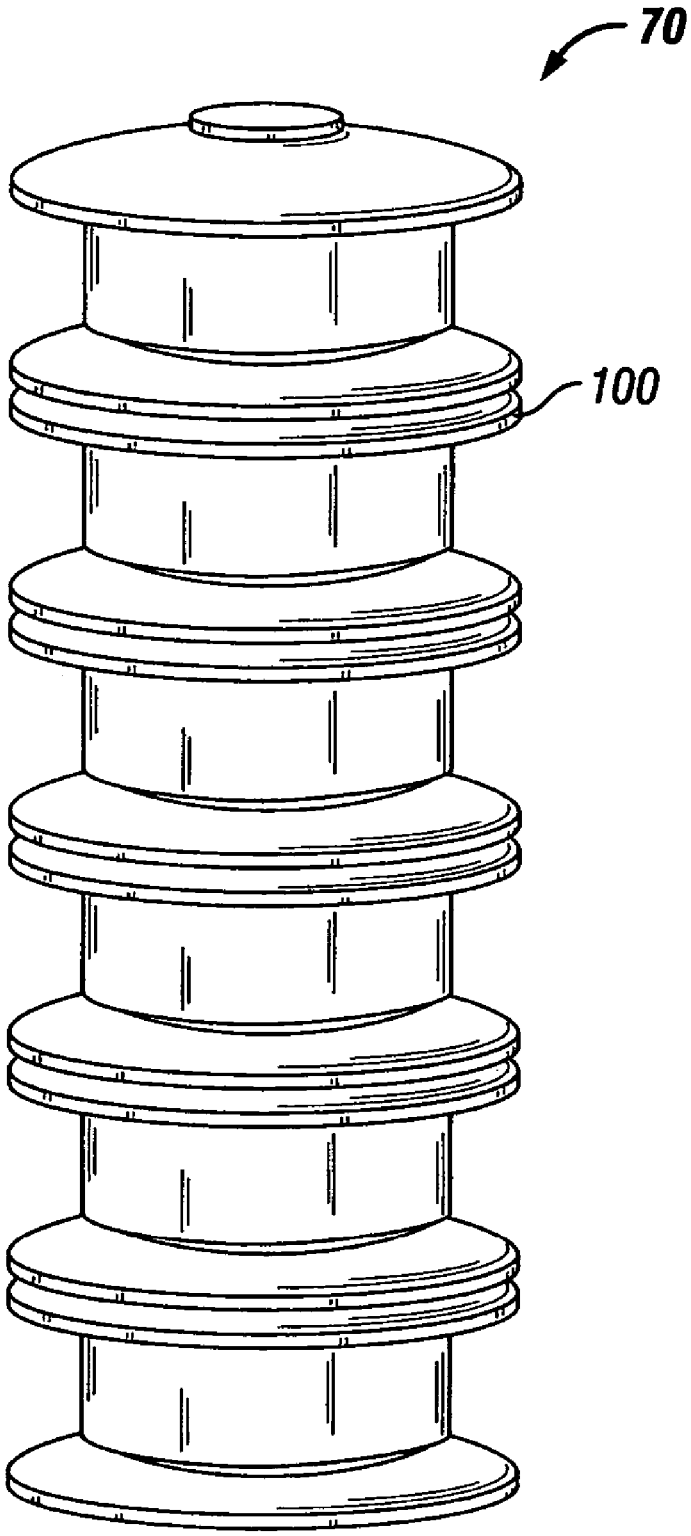
FIG. 4 is a perspective view of a stack of tires employing the tire storage system of FIG. 1, according to one embodiment of the invention.

Although the tires of FIG. 4 are all identical in size, the tire storage system 100 can be used with tires of different sizes as well. In some embodiments, the spacers 40 are available in multiple sizes to account for the variety of tire sizes. When stacking different sized tires, it is preferable that the larger tires be placed lower on the stack.

Although somewhat strong and rigid, the tire cap 50 is also somewhat flexible. The weight of the tire seated on the tire cap, for example, may flatten the sides 22 of the tire cap somewhat, particularly for those tire caps seated near the bottom of the tire stack 70. Despite some flexion of the base portion 54, and further due to the weight of the tire 30, the tire cap 50 maintains a somewhat secure contact with the bead 34 of the tire, so as to seal off or prevent access to the inside 28 of the tire when the tire storage system 100 is fully engaged.

Figure 5A:
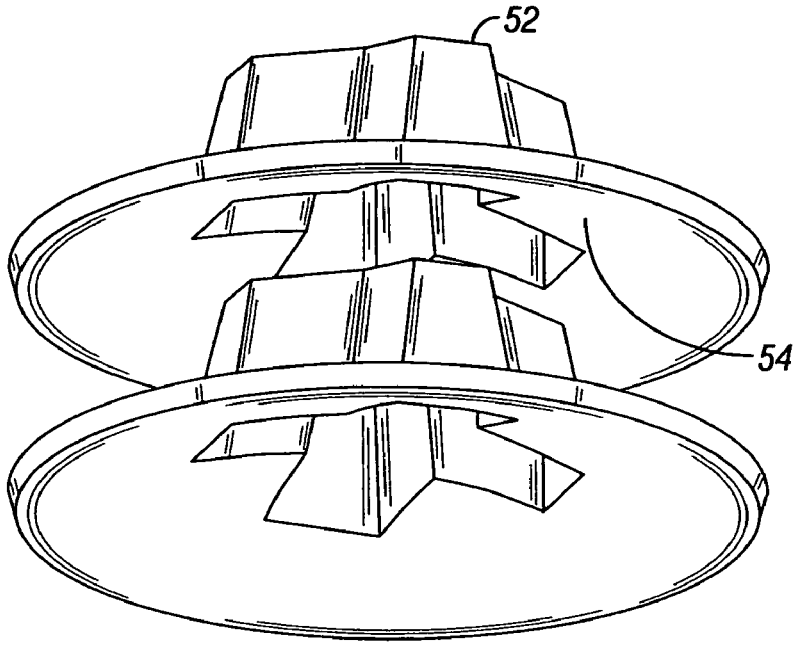
FIG. 5A is a perspective view of two tire caps used in the tire storage system of FIG. 1, according to one embodiment of the invention.
Figure 5B:
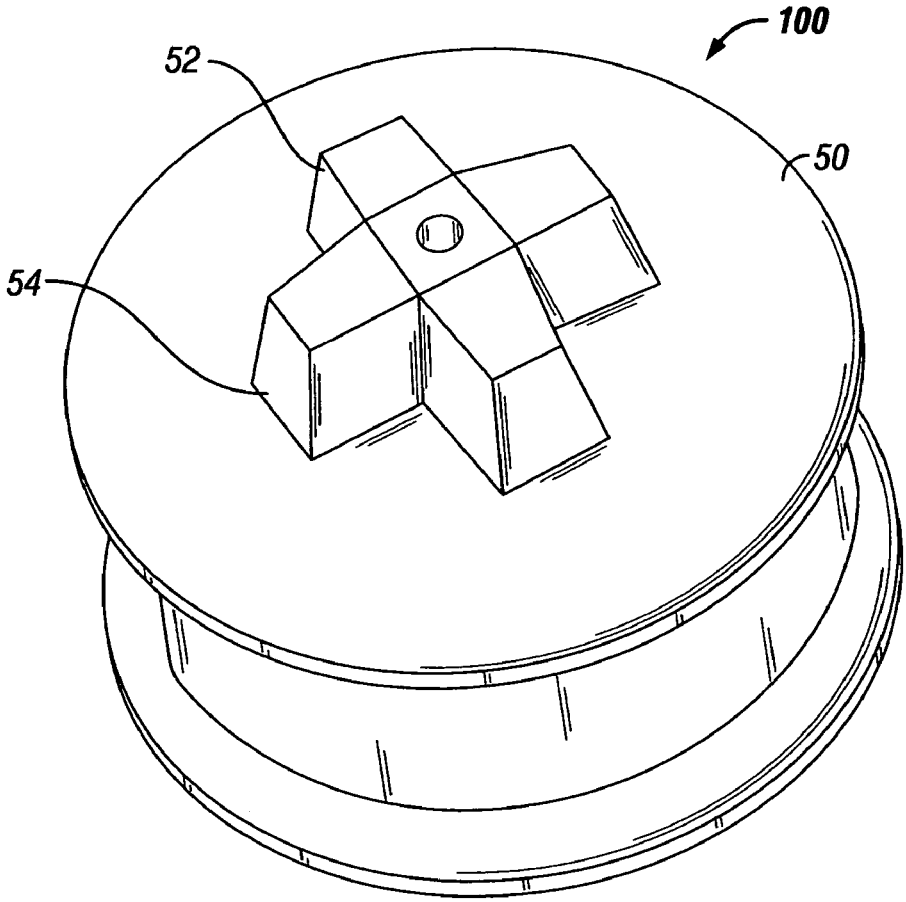
FIG. 5B is an overhead perspective view of the tire storage system of FIG. 1, according to one embodiment of the invention.
Figure 5C:
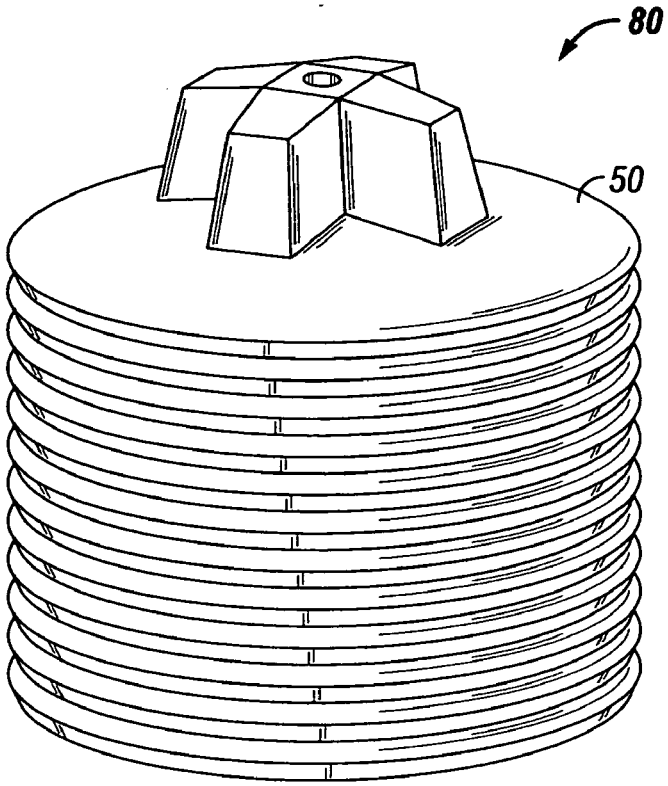
FIG. 5C is a perspective view of multiple tire caps stacked together, according to one embodiment of the invention.

While the tire storage system 100 is stackable with one or more other tire storage systems, the tire caps 50 are also stackable prior to use. Three views of the tire caps 50 are depicted in FIGS. 5A–5C, according to some embodiments. In the perspective view of FIG. 5A, two tire caps 50 are shown, each having a head portion 52 and a base portion 54. The birds-eye perspective view of FIG. 5B additionally shows that the head portion 52 is essentially a cross shape carved out of a cylinder. In FIG. 5A, it can be observed that the head portion 52 of the tire cap 50 is substantially hollow inside, such that a second tire cap can be fit inside the head portion. In FIG. 5C, a tire cap stack 80 is shown, in which several tire caps 50 are disposed atop one another. The stackability of the tire caps 50 results in more efficient storage of the tire caps prior to their intended use.

The head portion 52 is substantially hollow, for receiving additional tire caps in a stacking configuration (FIG. 5C), and is further shaped so as to fill some portion of the opening 32 of the tire 30. This configuration also provides some stability by lessening the likelihood that the tire will fall off the tire cap. Thus, the tire cap 50 is designed so as to be both stackable with other tire caps and insertable into the tire 30. While the head portion 52 of the tire cap 50 of FIGS. 5A–5C is formed into a cross-shaped cylinder, the head portion 52 may assume a number of different shapes, including, but not limited to cylinder shapes, cube shapes, star shapes, and so on.

The shape of the tire cap 50 is also designed with the tire size in mind. Preferably, the circumference of the head portion 52 is approximately the circumference of the bead of the smallest tire to be stored. When the tire 30 is placed over the tire cap 50, the head portion 52 substantially fills in the inside 28 of the tire and extends upward. The circumference of the base portion 54 may be larger than the circumference of the tire, but is at least larger than the circumference of the opening of the tire. In this manner, a single-sized tire cap can service multiple tire sizes.

The head portion 52 does not fill the entire opening of the tire. The spacer 40, placed between the upper and lower tire caps, substantially fills in the remainder of the opening 32 of the tire. The top portion 58 of the spacer rests upon the tire, over the bead 34.

In one embodiment, the spacers 40 are sized to approximate the remaining space of the tire opening not already occupied by the tire cap 50. Preferably, the body 18 of the spacer 40 has a circumference that is slightly smaller than that of the bead 34. Since tires come in a variety of sizes, the spacers 40 likewise are available in multiple sizes. In one embodiment, the spacers 40 are color-coded by size, for ready visual access to the appropriate spacer when used tires are being stacked.

Figure 6:
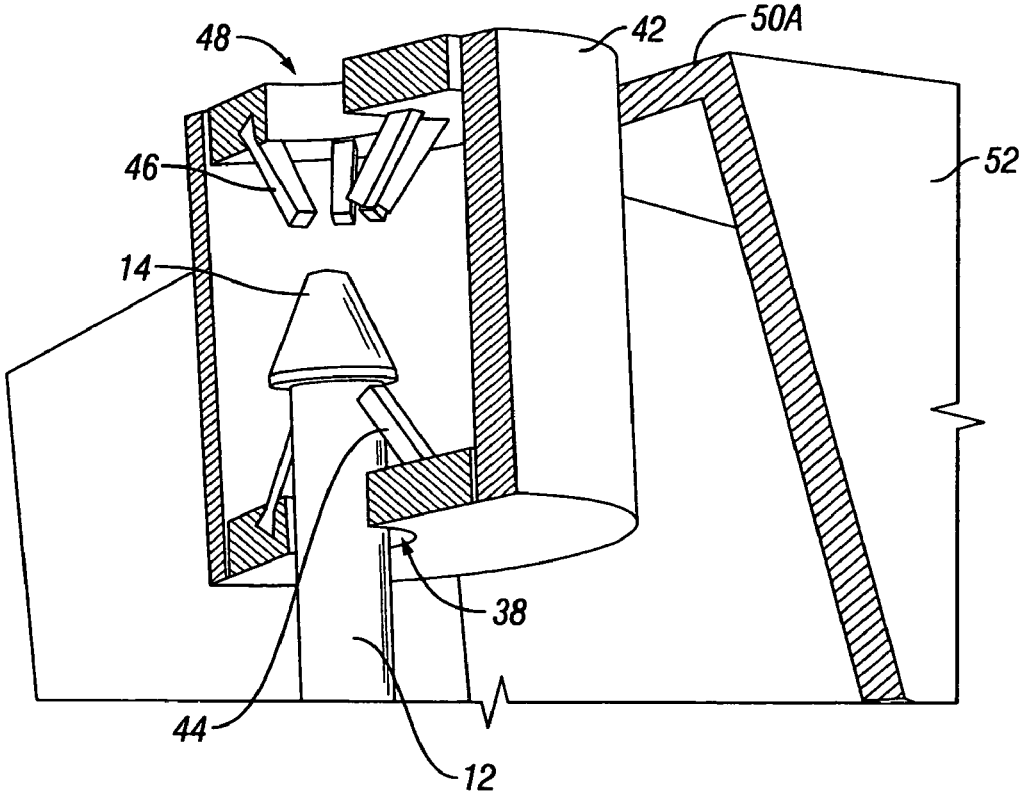
FIG. 6 is a cutaway perspective view of a portion of the tire cap of the tire storage system of FIG. 1, according to one embodiment of the invention.

As depicted in the perspective cutaway view of FIG. 6, the head portion 52 of the tire cap 50A further includes a chamber 42 for securely coupling the components of the tire storage system 100. The chamber 42 includes two openings, 38 and 48, through which the connecting rod 12 of the spacer 40 may be threaded.

Disposed adjacent to the opening 38, and extending upward therefrom, are a plurality of shafts 44. The shafts 44 are arranged around the opening and extend, not vertically upward, but upward at an angle so as to form a somewhat conical arrangement over the opening 38. In FIG. 6, the connecting rod 12 of the spacer 40 is shown, protruding through both the opening 38 and the arrangement of shafts 44. The tip 14 of the connecting rod 12, which is the upper tire cap tip of the spacer 40, is also conical in shape, with a base diameter that is slightly larger than the diameter of the conical formation of the shafts. The tips 14, 16 may also assume other shapes, such as a cylindrical or hexagonal cylinder shape, so long as the base of the tip has a diameter slightly larger than the connecting rod.

The relative arrangement of the tip and shaft ensures that, following insertion of the connecting rod 12 through the chamber 42, the connecting rod is not removable therefrom. The arrangement of the shafts 44 after insertion of the connecting rod 12 pushes against the base of the tip 14 when the connecting rod is pulled downward. In this manner, the engagement of the connecting rod 12 into the chamber 42 is one-way and thus permanent.

Designers of ordinary skill in the art recognize a number of ways in which a one-way coupling of the connecting rod to the chamber of the tire cap can be achieved. In another embodiment, the connecting rod 12 is not one-way, but after being securely connected through the chamber 42, can be removed from the chamber at a later time.

The tire storage system 100 is designed for permanent affixation to the tire 30. By permanently coupling the tire storage system with the tire, the tire cannot be infested with mosquitoes, snakes, rats, and other animal life during its period of dormancy, defined herein to be that time between its normal use (e.g., affixed to the rim of an automobile) and its ultimate recycling into other useful materials. The design ensures that stacked tires employing tire storage systems are not easily vandalized or destroyed.

However, a decoupling of the tire storage system from its respective tire may be desirable. The chamber 42 of each tire cap is disposed at the top of the head portion 52 of the tire cap. In one embodiment, the hole 48 at the top of the chamber is accessible from the tire cap, such that a tool may be inserted through the hole of the upper tire cap 50A after coupling to the tire. The tool may be a ratcheting-like tool that tightly grasps the tip, whether conical, cylindrical, or hexagonal, and severs or breaks the tip, freeing the connecting rod 12 for removal from the chamber 42. Such a tool may be used as an emergency disengagement mechanism to separate the tire storage system 100 from the tire 30 at a recycling center that has limited recycling capability (e.g., does not recycle plastics), as one example.

Since tire caps, whether upper tire caps or lower tire caps, are identical in configuration, the chamber 42 of the tire cap additionally includes features for using the tire cap as a lower tire cap 50B. In such an instance, a connection to a spacer 40 seated above the chamber 42 is made possible. In FIG. 6, a plurality of shafts 46 are disposed adjacent to the opening 48 (at the top of the chamber 42). These shafts 46 extend downward from the sides of the opening, not quite vertically downward, but so as to form a conical shape beneath the opening 48. Again, a connecting rod 12, this time coming from above the chamber 42 (not shown), may be threaded through the opening 48. The lower tire cap tip 16 (see FIGS. 2 and 3) is also conical in shape and has a tip diameter that, at its base, is slightly larger than the diameter of the conical formation of the shafts 46. Thus, when the lower tire cap tip 16 is pushed through the opening and through the collection of shafts 46, the direction of the connecting rod 12 cannot be reversed. In this manner, the lower tire cap 50B is securely coupled to the spacer 40.

In the illustration of FIG. 6, the space between the downwardly disposed shafts 46 and the upwardly disposed shafts 44 leaves room only for a single tire cap tip, either an upper tire cap tip 14 or a lower tire cap tip 16. This is because the tire caps 50 do not simultaneously operate as both a lower tire cap and as an upper tire cap.

In an alternative embodiment, however, the spacing between the shafts is large enough to accommodate both tips simultaneously. This configuration would allow a single tire cap to simultaneously operate as an upper tire cap and a lower tire cap. If configured in this manner, the tire stack 70 of FIG. 4 would change. Instead of having two tire caps between any two tires, a single tire cap could be used. However, the entire tire stack 70 would be tightly coupled together by the multiply engaged tire caps. For some operations, securing multiple tires together in this manner may prove unwieldy.

In the tire stack 70 of FIG. 4, by contrast, six distinct tire storage systems 100 are shown, one for each tire. Each tire storage system 100 is independently removable at any time from the other tires in the stack. This facilitates the movement of the tire stack 70 to another location, for example.

The tire storage system 100 can be built using a polymer or other plastic, which has been treated with a fire retardant. Alternatively, the components of the tire storage system can be treated with a fire retardant material after production. Tires stacked together using the tire storage system 100 are thus less likely to combust, in one embodiment.

By stacking tires using the tire storage system 100, additional benefits can be obtained. A more accurate accounting of the tires is possible when they are stacked, as in the tire stack 70 of FIG. 4. Further, the tire storage system 100 can be handled easily, for transporting the tires from one location to another.

Because mosquito infestation and fire hazards are so costly to communities, a tire storage system 100 may preferably be made available as each new tire is sold. Such a procedure can be enacted by state legislatures, for example. A purchaser of a new tire, such as a tire retailer, can then retrieve the used tire being replaced from the customer and immediately secure the used tire with the tire storage system. The retailer instantly has a convenient and safe mechanism for storing the used tire. The used tire is protected against mosquito infestation, and the associated animal life that follows the mosquito, as well as any fire hazards that might otherwise be possible, until such time as the used tire is hopefully recycled. Tire manufacturers and retailers may welcome such an ecologically conscious mechanism for dealing with this serious issue.

Figure 7:
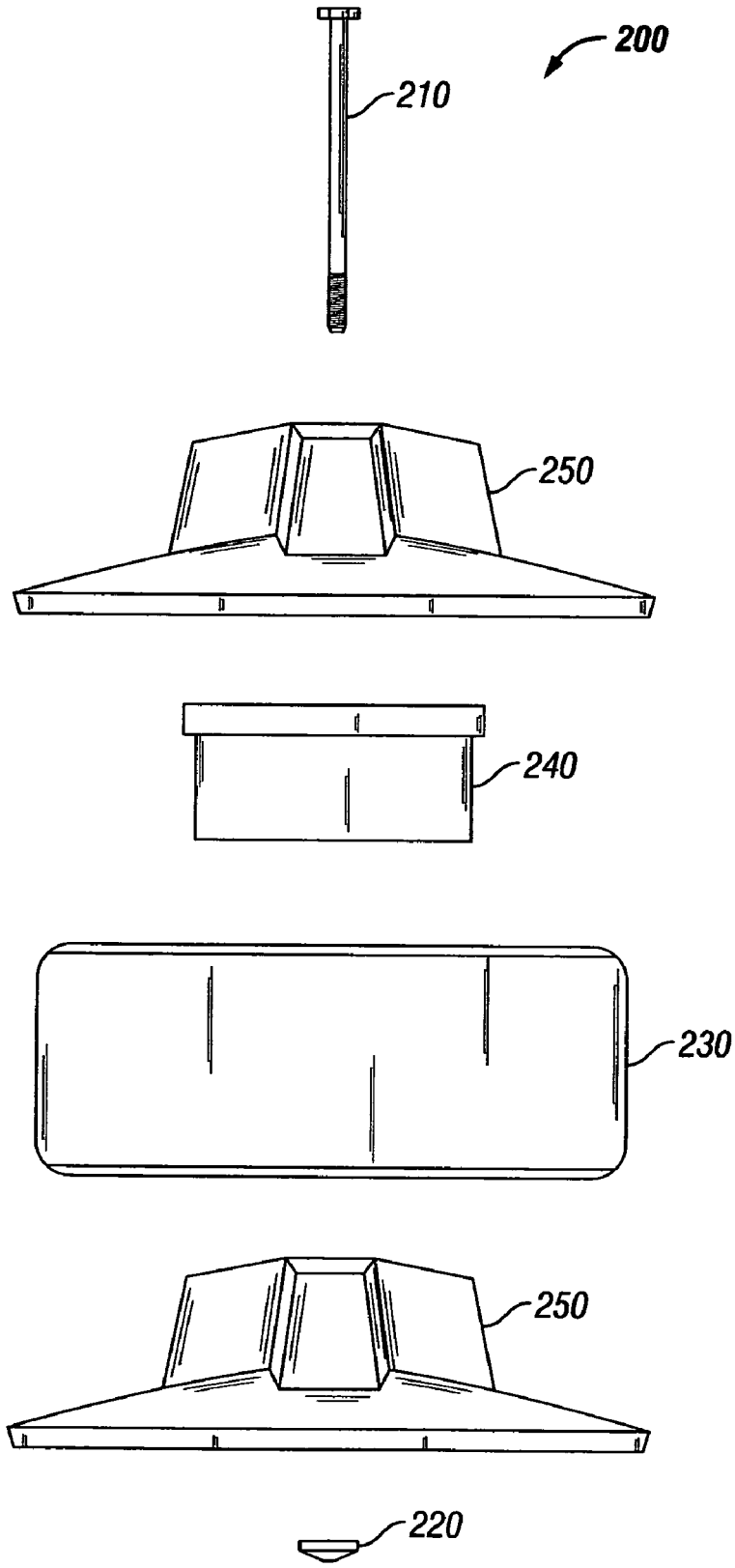
FIG. 7 is a side view of a second tire storage system, according to one embodiment of the invention.

The tire storage system can be implemented, as detailed above, with just three parts, or can be achieved using a more traditional approach. In an alternative embodiment, as depicted in FIG. 7, for example, a tire storage system 200 includes two tire caps 250 and a spacer 240 for enclosing a tire 230. In contrast to the spacer 40 of the tire storage system 100, the spacer 240 is a cylindrical piece with no engagement mechanism. A bolt 210 and a nut 220 are used for engaging the tire storage system 200. The bolt 210 is disposed through the upper tire cap, the tire, the spacer, and the lower tire cap, and the nut is screwed through the bolt to secure the components.

While the invention has been described with respect to a limited number of embodiments, those skilled in the art will appreciate numerous modifications and variations therefrom. It is intended that the appended claims cover all such modifications and variations as fall within the true spirit and scope of the invention.

We claim:

1. A tire storage system, comprising: a spacer to be placed in an opening of a tire, the opening being a cavity to dispose a rim of the tire, the rim being absent from the opening, the tire having a bead of a predetermined circumference and a hollow inside, the spacer comprising:

a top portion having a circumference greater than the predetermined circumference;

a cylindrical body having a center; and a connecting rod disposed orthogonally through the center of the body, two identical tire caps, a first tire cap and a second tire cap, the tire caps each comprising a head portion and a base portion, wherein the head portion of the first tire cap fits through the opening and the base portion of the second tire cap is disposed atop the tire, the connecting rod further comprising a first tip and a second tip, wherein the first tip engages securely with the head portion of the first tire cap and the second tip engages securely with the head portion of the second tire cap when the first tire cap and the second tire cap are affixed to the spacer; and the head portion further comprising a chamber having a first opening and a second opening, wherein the first tip threads through the second opening of the chamber of the first tire cap and the second tip threads through the first opening of the chamber of the second tire cap when the first tire cap and the second tire cap are affixed to the spacer;

wherein the spacer and the head portion of the first tire cap substantially fill the opening of the tire.

2. The tire storage system of claim 1, the first opening and second opening further comprising shafts for preventing the tips from being disengaged from the chambers.

3. The tire storage system of claim 1, wherein the spacer and tire caps are formed from an elastomeric compound.

4. The tire storage system of claim 3, wherein the elastomeric compound includes a fire-retardant material.

5. The tire storage system of claim 3, wherein the spacer and the tire caps are treated with a fire-retardant material after formation.

6. The tire storage system of claim 1, wherein the first tire cap is stackable atop a second tire storage system.

7. The tire storage system of claim 1, wherein a second tire storage system can be stacked atop the second tire cap.

8. The tire storage system of claim 1, wherein the first tire cap is stackable atop the second tire cap prior to being engaged with the spacer, and the second tire cap is stackable atop the first tire cap prior to being engaged with the spacer.

9. The tire storage system of claim 1, wherein the base portion of each tire cap has gently sloping, flexible sides, wherein the sides slightly flatten when the tire is disposed atop the tire cap.

10. The tire storage system of claim 1, wherein the top portion of the spacer is disposed over the bead of the tire when the tire storage system is fully engaged.

11. The tire storage system of claim 1, wherein the size of the spacer is tailored to the size of the opening of the tire.

12. The tire storage system of claim 11, further comprising a second spacer, wherein the second spacer is larger than the first spacer.

13. The tire storage system of claim 12, wherein the second spacer is a different color from the first spacer.

14. The tire storage system of claim 1, wherein the head portion is cross-shaped, when viewed from overhead.

15. The tire storage system of claim 1, wherein mosquitoes are prevented from breeding inside the tire.

16. The tire storage system of claim 9, wherein the flattening of the sides of the base portion against the tire seals the tire against the base portion.

17. The tire storage system of claim 1, wherein the tips may be severed for emergency disengagement of the tire storage system.

18. The tire storage system of claim 1, wherein the tips are conical in shape.

* * * * *